US011371538B2

(12) United States Patent
Fukui et al.

(10) Patent No.: US 11,371,538 B2
(45) Date of Patent: Jun. 28, 2022

(54) FLUID PRESSURE CYLINDER

(71) Applicant: SMC CORPORATION, Chiyoda-ku (JP)

(72) Inventors: Chiaki Fukui, Abiko (JP); Tetsuya Ikari, Moriya (JP); Takeshi Seo, Nagareyama (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 17/040,196

(22) PCT Filed: Mar. 8, 2019

(86) PCT No.: PCT/JP2019/009349
§ 371 (c)(1),
(2) Date: Sep. 22, 2020

(87) PCT Pub. No.: WO2019/181565
PCT Pub. Date: Sep. 26, 2019

(65) Prior Publication Data

US 2021/0010494 A1 Jan. 14, 2021

(30) Foreign Application Priority Data

Mar. 23, 2018 (JP) ..... JP2018-055449

(51) Int. Cl.
*F15B 15/28* (2006.01)
*F15B 15/14* (2006.01)

(52) U.S. Cl.
CPC ..... *F15B 15/2892* (2013.01); *F15B 15/14* (2013.01)

(58) Field of Classification Search
CPC .. F15B 15/1471; F15B 15/28; F15B 15/2807; F15B 15/2892
See application file for complete search history.

(56) References Cited

U.S. PATENT DOCUMENTS 3,639,868 A * 2/1972 Gasper ..... F15B 15/2892 335/205
4,835,505 A * 5/1989 Hattori ..... G01P 1/00 335/302

(Continued)

FOREIGN PATENT DOCUMENTS

FR 2370907 A1 * 6/1978 ..... F15B 15/2807
JP 61-87207 U 6/1986

(Continued)

OTHER PUBLICATIONS

International Search Report dated May 28, 2019 in PCT/JP2019/009349 filed on Mar. 8, 2019, 1 page.

(Continued)

*Primary Examiner* — Kenneth Bomberg
*Assistant Examiner* — Matthew Wiblin
(74) *Attorney, Agent, or Firm* — Oblon, McClelland, Maier & Neustadt, L.L.P.

(57) ABSTRACT

A fluid pressure cylinder is provided with a cylinder tube having a sliding hole internally; a piston unit disposed along the sliding hole so as to be capable of moving back and forth, and a piston rod projected in the axial direction from the piston unit. The piston unit can shorten the axial dimension of a piston body by mounting a wear ring to an outer circumferential section of a ring-shaped magnet attached to an outer circumferential section of the piston body.

11 Claims, 6 Drawing Sheets

(56) References Cited

U.S. PATENT DOCUMENTS

| | | | | |
|---|---|---|---|---|
| 4,998,084 | A * | 3/1991 | Alff | G01D 5/12 310/168 |
| 6,310,473 | B1 * | 10/2001 | Zhao | G01D 5/145 324/207.2 |
| 10,851,813 | B2 | 12/2020 | Odaka | |
| 2007/0024405 | A1 * | 2/2007 | Terasaki | H01F 7/021 335/302 |
| 2008/0173169 | A1 | 7/2008 | Ikari | |
| 2016/0076560 | A1 * | 3/2016 | Nomura | F15B 15/1438 92/169.1 |
| 2020/0072254 | A1 * | 3/2020 | Odaka | F15B 15/22 |

FOREIGN PATENT DOCUMENTS

| | | | |
|---|---|---|---|
| JP | 2001-234903 | A | 8/2001 |
| JP | 2008-133920 | A | 6/2008 |
| WO | WO 2018/030012 | A1 | 2/2018 |

OTHER PUBLICATIONS

Indian Office dated Apr. 2, 2021 in Indian Patent Application No. 202047045410, 5 pages.

* cited by examiner

FLUID PRESSURE CYLINDER

TECHNICAL FIELD

The present invention relates to a fluid pressure cylinder including a piston on which a magnet is disposed.

BACKGROUND ART

For example, fluid pressure cylinders including pistons configured to displaced according to supply of pressurized fluid have been known as means for carrying workpieces and the like (actuators). A typical fluid pressure cylinder includes a cylinder tube, a piston disposed inside the cylinder tube to be movable in the axial direction, and a piston rod connected to the piston.

Moreover, a fluid pressure cylinder including a magnet attached to a piston to detect the position of the piston is also known. For example, in a fluid pressure cylinder disclosed in Japanese Laid-Open Patent Publication No. 2008-133920, a ring-shaped magnet is attached to an outer circumferential part of a piston, and a magnetic sensor is disposed outside a cylinder tube.

SUMMARY OF INVENTION

Pistons to which magnets are attached usually have greater axial dimensions than pistons to which magnets are not attached. As the axial dimension of a piston increases, the total length of a fluid pressure cylinder unfavorably increases accordingly.

The present invention has the object of providing a fluid pressure cylinder of which axial dimension can be reduced.

In order to achieve the above-described object, a fluid pressure cylinder according to an aspect of the present invention includes a cylinder tube containing therein a slide hole, a piston unit disposed to be reciprocable along the slide hole, and a piston rod protruding from the piston unit in an axial direction, wherein the piston unit includes a piston body protruding radially outward from the piston rod, a packing attached to an outer circumferential part of the piston body, a ring-shaped magnet attached to the outer circumferential part of the piston body, and a wear ring attached to an outer circumferential part of the ring-shaped magnet.

According to the above-described fluid pressure cylinder, since the wear ring is attached to the outer circumferential part of the ring-shaped magnet, the axial dimension of the piston body can be reduced compared with a case where the wear ring and the magnet are disposed in different axial positions.

In the above-described fluid pressure cylinder, the magnet may be disposed within an axial range of the wear ring.

With this structure, the axial dimension of the wear ring can be reduced, and thus the axial dimension of the piston body can be reduced.

In the above-described fluid pressure cylinder, a central position of the magnet and a central position of the wear ring in the axial direction may coincide with each other.

With this structure, the wear ring can be attached to the magnet to cover the outer circumferential part of the magnet. This facilitates the attachment of the wear ring to the outer circumferential part of the magnet and, at the same time, results in a reduction in the axial dimension of the wear ring.

In the above-described fluid pressure cylinder, a plurality of opening portions may be formed in an outer circumferential part of the wear ring at intervals in a circumferential direction, and a plurality of protrusions protruding radially outward may be formed on the outer circumferential part of the magnet at intervals in the circumferential direction, the protrusions being inserted into the opening portions of the wear ring.

With this structure, the magnet can protrude toward the inside of the opening portions of the wear ring and can be disposed closer to a magnetic sensor. As a result, the magnetic force the magnet is required to have is reduced. Thus, the magnet can be made smaller, and thinner in the axial direction, thereby leading to a further reduction in the axial dimension of the piston body.

In the above-described fluid pressure cylinder, a circumferential portion extending in the circumferential direction may be formed at an end of the wear ring in the axial direction.

With this structure, the ring shape of the wear ring can be maintained even in the case the wear ring has the opening portions.

In the above-described fluid pressure cylinder, a circumferential portion extending in the circumferential direction may be formed at each of both ends of the wear ring in the axial direction.

With this structure, both ends of the wear ring in the axial direction are supported by the circumferential portions. Thus, the mechanical strength of the wear ring increases.

In the above-described fluid pressure cylinder, an outer circumferential surface of each of the protrusions of the magnet may be formed in a position being radially identical to or protruding radially outward from a position of an outer circumferential surface of the piston body.

With this structure, the protrusions of the magnet can be disposed even closer to the magnetic sensor. As a result, the axial dimension of the magnet can be further reduced, thereby leading to a further reduction in the axial dimension of the piston body.

In the above-described fluid pressure cylinder, a height of the protrusions of the magnet may be within a range of a thickness of the wear ring.

With this structure, the protrusions of the magnet can be prevented from coming into contact with the slide hole.

In the above-described fluid pressure cylinder, a circumferential width of the protrusions of the magnet may be greater than a circumferential width of recesses.

This structure can increase the circumferential position range in which the magnetic sensor can be attached.

In the above-described fluid pressure cylinder, the wear ring may include a first catch portion configured to be brought into abutment with one end face of the magnet in the axial direction and a second catch portion configured to be brought into abutment with another end face of the magnet in the axial direction.

With this structure, the wear ring can be reliably attached to the outer circumferential part of the magnet.

In the above-described fluid pressure cylinder, the piston body may include a packing receiving groove, a magnet arrangement groove, and a wear ring arrangement groove, each having a circular ring shape, formed in the outer circumferential part of the piston body, the wear ring arrangement groove may be wider in the axial direction and shallower than the magnet arrangement groove, and the magnet arrangement groove may be formed within a range of an axial width of the wear ring arrangement groove.

With this structure, the wear ring can be attached to the outer circumferential part of the magnet.

In the above-described fluid pressure cylinder, a central position of the magnet arrangement groove in the axial direction and a central position of the wear ring arrangement groove in the axial direction may coincide with each other.

With this structure, the wear ring can be attached to the magnet to hold the magnet from both ends in the axial direction, resulting in a reduction in the axial dimension of the wear ring.

In accordance with the fluid pressure cylinder according to the above-described aspect, the axial dimension can be reduced.

DESCRIPTION OF EMBODIMENTS

Figure 1:
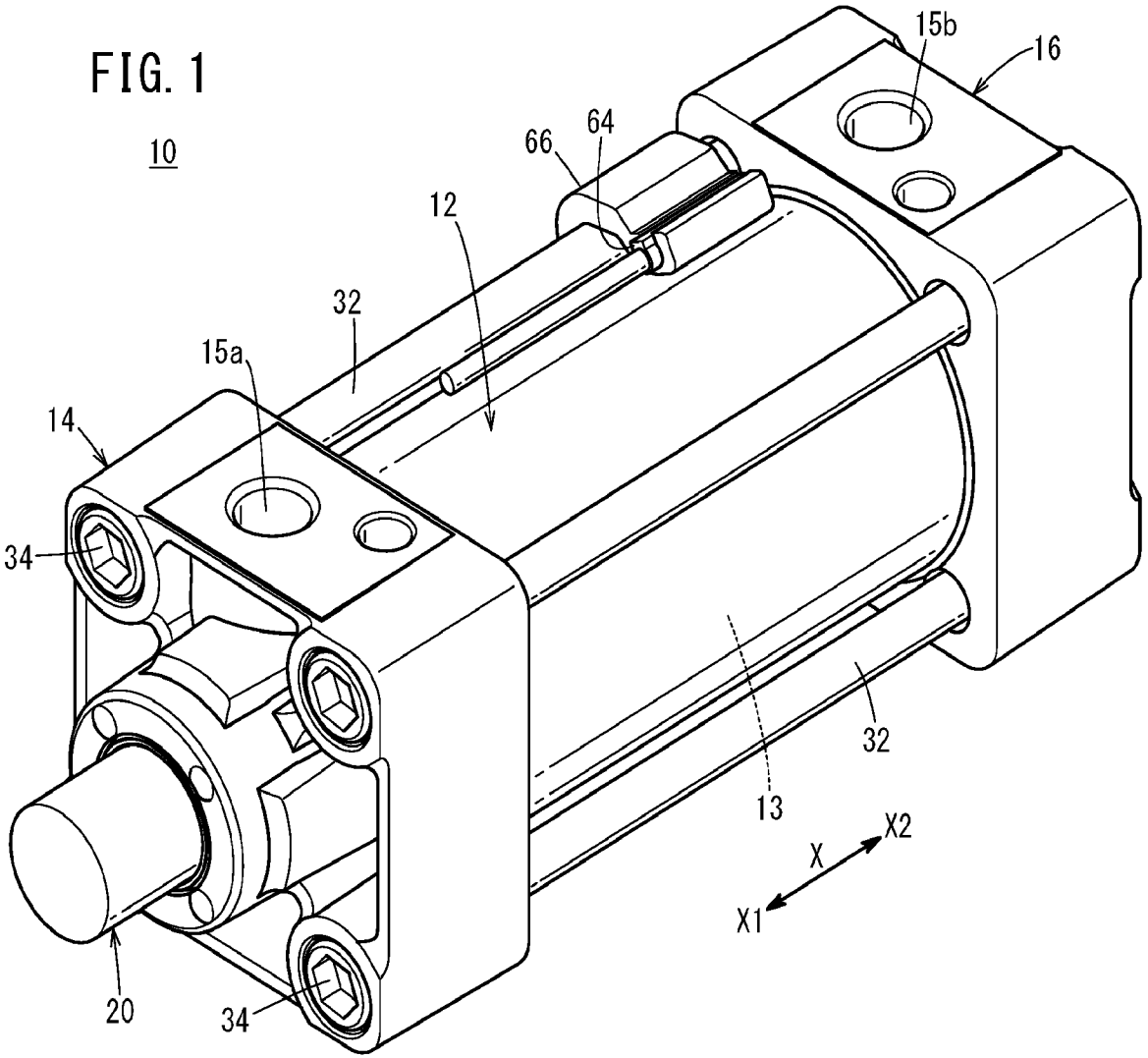
FIG. 1 is a perspective view of a fluid pressure cylinder according to a first embodiment of the present invention.

Preferred embodiments of the present invention will be described in detail below with reference to the accompanying drawings. The ratio of the dimensions in the drawings may be exaggerated and differ from the actual ratio for ease of explanation. Moreover, in the description below, the direction along which the central axis of a cylinder tube extends is referred to as the axial direction (X direction).

First Embodiment

Figure 2:
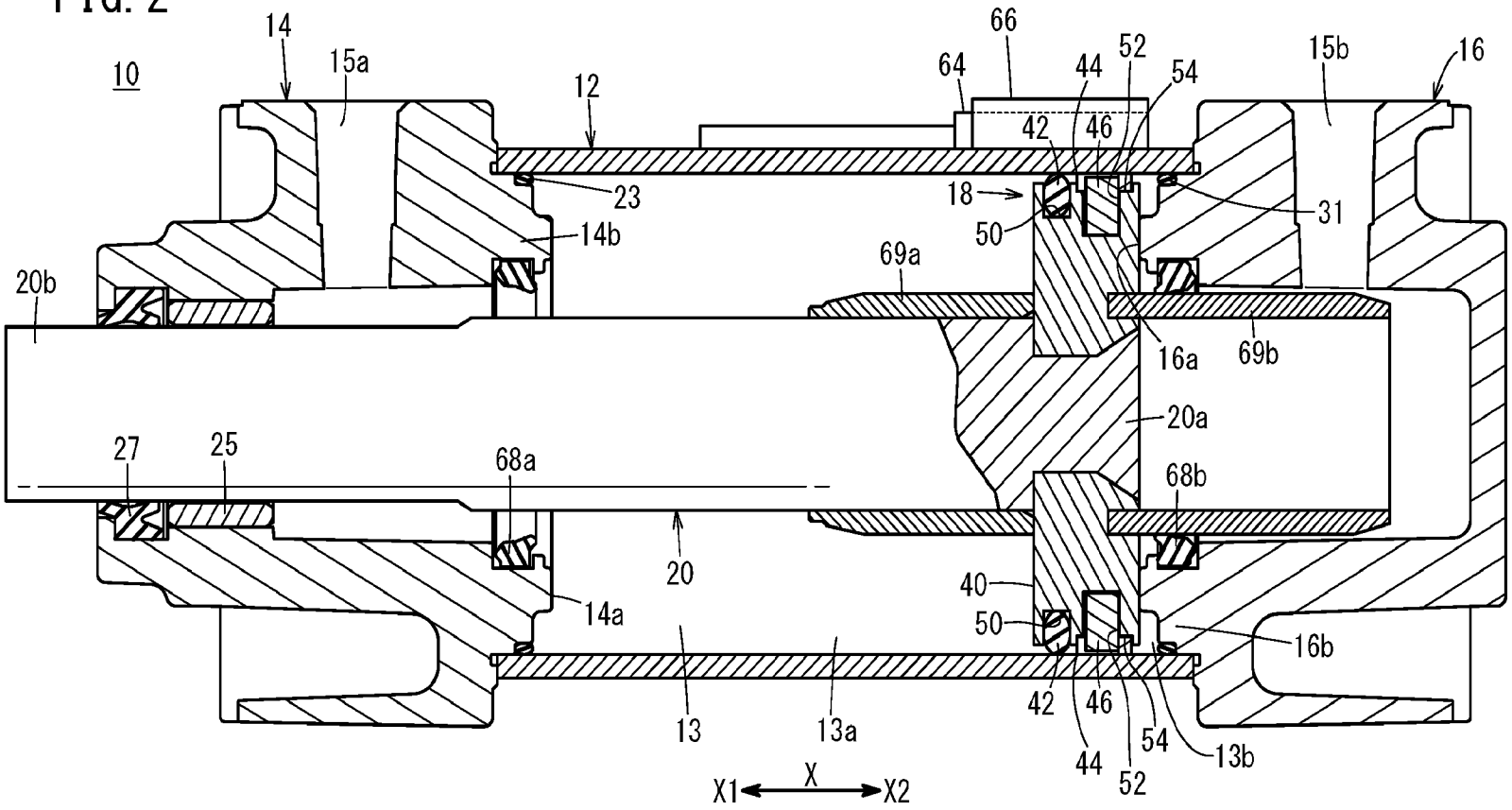
FIG. 2 is a cross-sectional view of the fluid pressure cylinder in FIG. 1.
Figure 3:
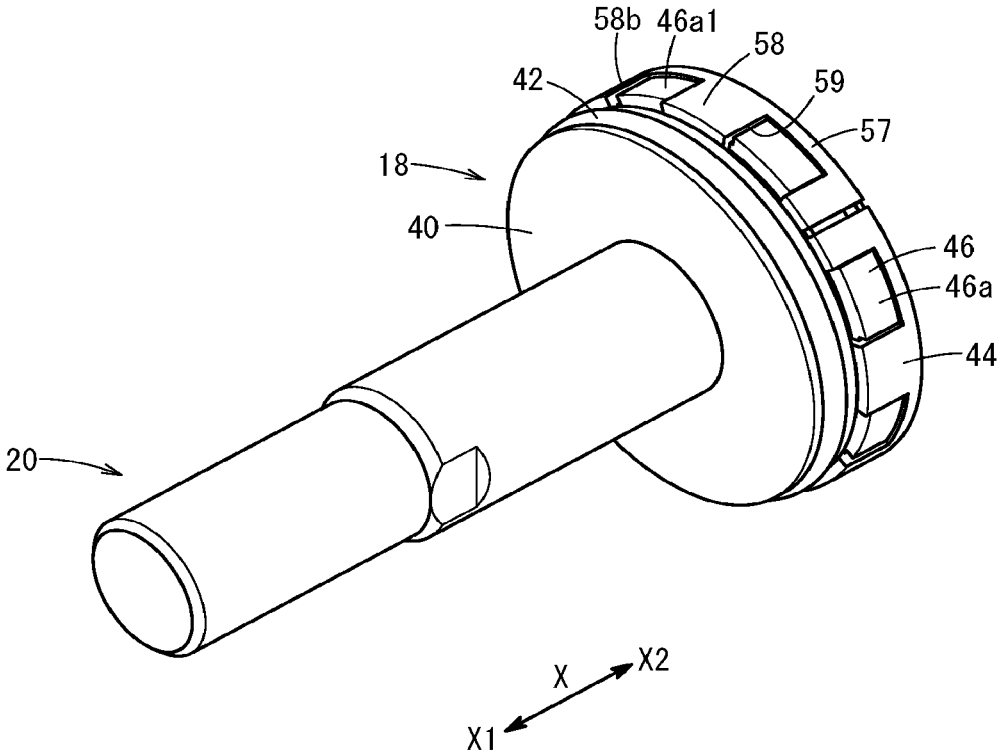
FIG. 3 is a perspective view of a piston unit of the fluid pressure cylinder in FIG. 1.

A fluid pressure cylinder 10 according to a first embodiment illustrated in FIG. 1 includes a hollow cylindrical cylinder tube 12 having therein a circular slide hole 13 (cylinder chamber), a rod cover 14 disposed at one end part of the cylinder tube 12, and a head cover 16 disposed at another end part of the cylinder tube 12. As illustrated in FIGS. 2 and 3, the fluid pressure cylinder 10 further includes a piston unit 18 disposed inside the cylinder tube 12 so as to be movable in the axial direction (X direction) and a piston rod 20 connected to the piston unit 18. The fluid pressure cylinder 10 is used as an actuator for, for example, transporting a workpiece.

The cylinder tube 12 is a tubular body composed of, for example, a metal material such as aluminum alloy, and extends in the axial direction. In the first embodiment, the cylinder tube 12 has a hollow cylindrical shape.

As illustrated in FIGS. 1 and 2, the rod cover 14 is provided to block up the one end part (an end part on a side of a direction of an arrow X1) of the cylinder tube 12 and is a member composed of, for example, a metal material similar to the material of the cylinder tube 12. The rod cover 14 has a first port 15*a*. As illustrated in FIG. 2, an annular protruding portion 14*b* formed on the rod cover 14 is inserted into the one end part of the cylinder tube 12.

A packing 23 with a circular ring shape is disposed between the rod cover 14 and the cylinder tube 12. A bush 25 with a circular ring shape and a packing 27 with a circular ring shape are disposed in an inner circumferential part of the rod cover 14. A first cushion packing 68*a* with a circular ring shape is disposed in the inner circumferential part of the rod cover 14.

The head cover 16 is a member composed of, for example, a metal material similar to the material of the cylinder tube 12 and is provided to block up the other end part (an end part on a side of a direction of an arrow X2) of the cylinder tube 12. The other end part of the cylinder tube 12 is airtightly closed by the head cover 16. The head cover 16 has a second port 15*b*.

An annular protruding portion 16*b* formed on the head cover 16 is inserted into the other end part of the cylinder tube 12. A packing 31 with a circular ring shape is disposed between the head cover 16 and the cylinder tube 12. A second cushion packing 68*b* with a circular ring shape is disposed in an inner circumferential part of the head cover 16.

As illustrated in FIG. 1, the cylinder tube 12, the rod cover 14, and the head cover 16 are fastened to each other in the axial direction by a plurality of connecting rods 32 and a plurality of nuts 34. The plurality of pairs of connecting rods 32 and nuts 34 are disposed at intervals in the circumferential direction. Thus, the cylinder tube 12 is secured while being held between the head cover 16 and the rod cover 14.

As illustrated in FIG. 2, the piston unit 18 is accommodated inside the cylinder tube 12 (slide hole 13) to be slidable in the axial direction and partitions the inside of the slide hole 13 into a first pressure chamber 13*a* adjacent to the first port 15*a* and a second pressure chamber 13*b* adjacent to the second port 15*b*. In this embodiment, the piston unit 18 is connected to a base end portion 20*a* of the piston rod 20.

Figure 4:
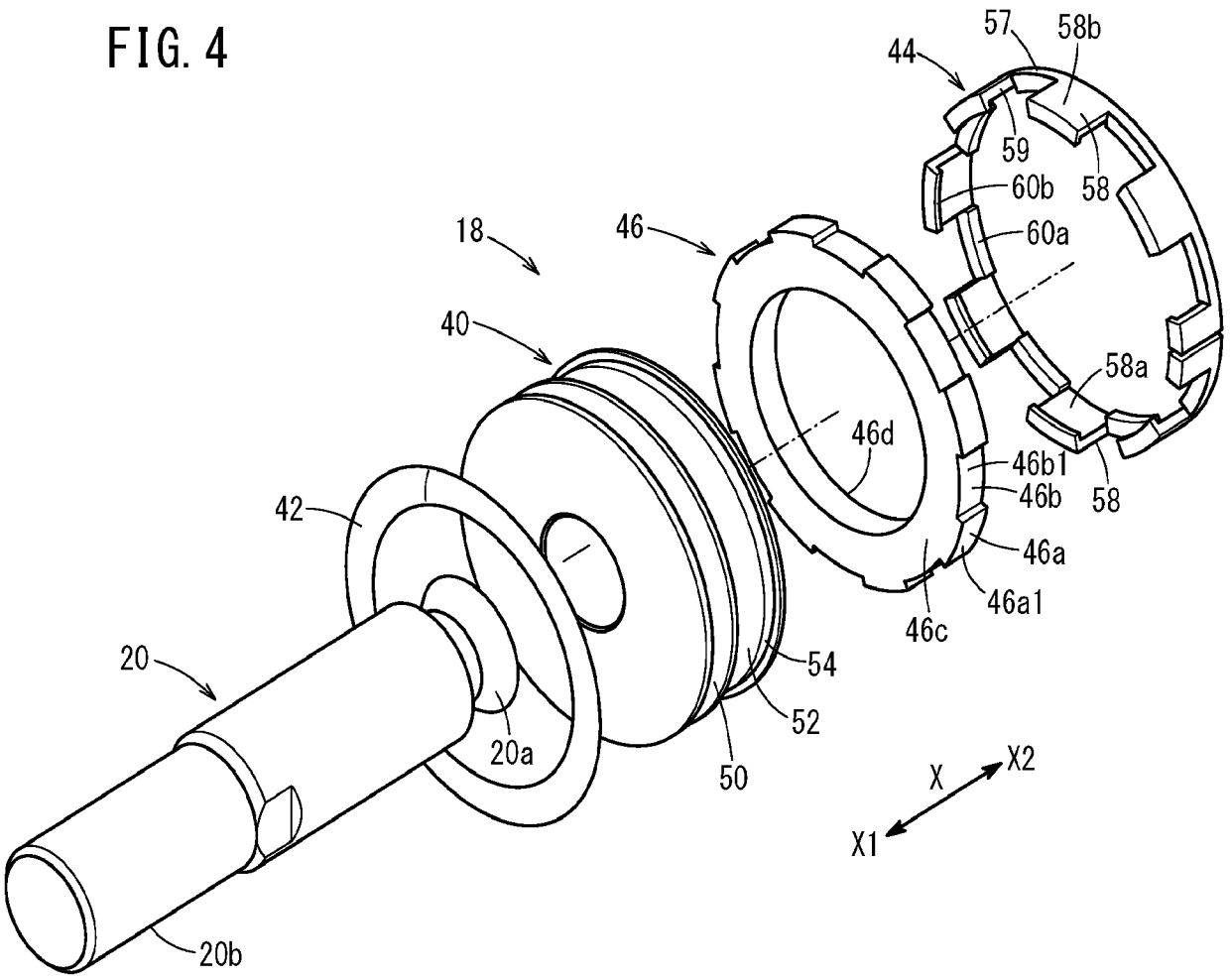
FIG. 4 is an exploded perspective view of the piston unit in FIG. 3.

As illustrated in FIG. 4, the piston unit 18 includes a circular piston body 40 protruding radially outward from the piston rod 20, a circular-ring-shaped packing 42 attached to an outer circumferential part of the piston body 40, a ring-shaped magnet 46 attached to the outer circumferential part of the piston body 40, and a wear ring 44 attached to an outer circumferential part of the magnet 46.

A packing receiving groove 50, a magnet arrangement groove 52, and a wear ring arrangement groove 54 are formed in the outer circumferential surface of the piston body 40. The packing receiving groove 50 and the magnet arrangement groove 52 are disposed in different axial positions. The wear ring arrangement groove 54 is a shallow groove formed by cutting off both side parts of the magnet arrangement groove 52 from the outer circumference side, and the central position of the wear ring arrangement groove 54 in the axial direction coincides with the central position of the magnet arrangement groove 52 in the axial direction. The packing receiving groove 50, the magnet arrangement groove 52, and the wear ring arrangement groove 54 each have a circular ring shape extending around the entire circumference in the circumferential direction.

The constituent material of the piston body 40 includes, for example, metal materials such as carbon steel, stainless steel, and aluminum alloy, and hard resin.

The packing 42 is a ring-shaped seal member (for example, O-ring) composed of an elastic material such as rubber or elastomer. The packing 42 is fitted in the packing receiving groove 50.

The packing 42 is in contact with the inner circumferential surface of the cylinder tube 12 so as to be slidable. Specifically, an outer circumferential part of the packing 42 is in close contact with the outer circumferential surface of the piston body 40 along the entire circumference in an airtight or liquid-tight manner. The packing 42 seals a gap between the outer circumferential surface of the piston unit 18 and the inner circumferential surface of the slide hole 13 to thereby airtightly or fluid tightly partition the inside of the slide hole 13 into the first pressure chamber 13*a* and the second pressure chamber 13*b*.

To restrict rotation of the piston unit 18, a rotation-preventing protrusion may be formed on the packing 42, and a rotation-preventing groove configured to be engaged with the rotation-preventing protrusion may be formed in the cylinder tube 12.

The wear ring 44 is attached to the outer circumference of the ring-shaped magnet 46 mounted on the outer circumferential part of the piston body 40. The wear ring 44 includes a circumferential portion 57 extending in the circumferential direction, sliding portions 58 covering the outer circumference of the magnet 46, and a plurality of opening portions 59 disposed at intervals in the circumferential direction. The circumferential portion 57 is formed at another end part (an end part on the X2 side) of the wear ring 44 and extends in the circumferential direction. The circumferential portion 57 is integrated with the sliding portions 58 and supports the sliding portions 58. That is, the plurality of sliding portions 58 divided by the opening portions 59 are kept in a ring shape by the circumferential portion 57.

The sliding portions 58 each have an outer circumferential surface 58*b* forming the outer circumference of the wear ring 44, and the outer circumferential surfaces 58*b* are contact with the inner surface of the slide hole 13 of the cylinder tube 12. The axial width of the sliding portions 58 is greater than the axial width of the magnet 46. The inner circumferential surfaces 58*a* of the sliding portions 58 face the outer circumferential surfaces 46*b*1 of recesses 46*b* of the magnet 46. To prevent the load of the wear ring 44 from being applied to the magnet 46, it is preferable that a small gap be left between the outer circumferential surfaces 46*b*1 of the recesses 46*b* of the magnet 46 and the inner circumferential surfaces 58*a* of the sliding portions 58.

The opening portions 59 are formed by cutting out portions of the sliding portion 58 of the wear ring 44 to expose the outer circumferential part of the magnet 46 through the opening portions 59. In this embodiment, the opening portions 59 extend to one end (an end on the arrow X1 side) of the wear ring 44. That is, the one end of the wear ring 44 is cut out and divided by the opening portions 59. The sliding portions 58 and the opening portions 59 are disposed alternately in the circumferential direction, and the circumferential width (angular range) of each of the sliding portions 58 may be, for example, approximately 10°, and the circumferential width (angular range) of each of the opening portions 59 may be, for example, approximately 20°. The range in which a magnetic sensor 64 can be installed is preferably increased by making the circumferential width of the opening portions 59 greater than the circumferential width of the sliding portions 58 in this manner. Note that the circumferential width of the sliding portions 58 may be greater than the circumferential width of the opening portions 59.

The total axial dimension of the sliding portion 58 and the circumferential portion 57 is greater than the axial dimension of the magnet 46, and the wear ring 44 is attached such that the central position of the wear ring 44 in the axial direction coincides with the central position of the magnet 46 in the axial direction as shown in FIGS. 2 and 3. The circumferential portion 57 protrudes beyond the magnet 46 toward another end side (in the X2 direction), and first ends (ends on the X1 direction side) of the sliding portions 58 extend toward one end side beyond the magnet 46.

First catch portions 60*a* are formed on the inner circumference of the circumferential portion 57 so as to protrude inward more than the inner circumferential surfaces 58*a* of the sliding portions 58. Second catch portions 60*b* are formed on ends of the sliding portions 58 on the first end side so as to protrude inward more than the inner circumferential surfaces 58*a*. The first catch portions 60*a* are in abutment with an end face 46*d* of the magnet 46 on another end side of the magnet 46, and the second catch portions 60*b* are in abutment with an end face 46*c* of the magnet 46 on the one end side of the magnet 46. That is, the wear ring 44 is attached to the magnet 46 such that the magnet 46 is held between the first catch portions 60*a* and the second catch portions 60*b* from both sides in the axial direction. The first catch portions 60*a* and the second catch portions 60*b* are inserted into the wear ring arrangement groove 54 in the piston body 40 (see FIG. 2). In the example shown in FIG. 4, the first catch portions 60*a* are formed only at areas adjacent to the opening portions 59. However, the present embodiment is not limited to this, and the first catch portions 60*a* may be formed in the entire area in the circumferential direction.

The wear ring 44 is composed of a low friction material. The friction coefficient between the wear ring 44 and the slide hole 13 is smaller than the friction coefficient between the packing 42 and the slide hole 13. Such a low friction material includes, for example, synthetic resins with a low coefficient of friction and a high resistance to wear such as polytetrafluoroethylene (PTFE) and metal materials (for example, bearing steel).

The magnet 46 has a ring shape, and includes protrusions 46*a* protruding radially outward and the recesses 46*b* disposed between the protrusions 46*a*, in the outer circumferential part. The protrusions 46*a* and the recesses 46*b* are disposed alternately at predetermined intervals in the circumferential direction. The protrusions 46*a* are disposed at positions corresponding to the opening portions 59 of the wear ring 44, and the outer circumferential surfaces 46*a*1 of the protrusions 46*a* protrude radially outward more than the inner circumferential surfaces 58*a* of the sliding portions 58 of the wear ring 44. To prevent contact with the slide hole 13, the outer circumferential surfaces 46*a*1 of the protrusions 46*a* are disposed radially inward more than the outer circumferential surfaces 58*b* of the sliding portions 58. That is, the height of the protrusions 46*a* lies within a range of the thickness of the sliding portions 58 of the wear ring 44. The outer circumferential surfaces 46*a*1 of the protrusions 46*a* may be disposed in positions corresponding to the position of the outer circumferential surface of the piston body 40 in radial directions. Moreover, the outer circumferential surfaces 46*a*1 of the protrusions 46*a* may protrude radially outward more than the outer circumferential surface of the piston body 40.

On the other hand, the recesses 46*b* of the magnet 46 are disposed in areas corresponding to the sliding portions 58 of the wear ring 44, and the outer circumferential surfaces 46*b*1 of the recesses 46*b* are covered with the sliding portions 58. The magnet 46 may be formed of, for example, a ferrite magnet or a rare earth magnet.

As illustrated in FIG. 1, the magnetic sensor 64 is attached to the outside of the cylinder tube 12. Specifically, a sensor bracket 66 is attached to one of the connecting rods 32. The magnetic sensor 64 is held by the sensor bracket 66. Thus, the position of the magnetic sensor 64 is fixed with respect to the head cover 16 and the rod cover 14 via the sensor bracket 66 and the connecting rod 32. The magnetic sensor 64 detects magnetism generated by the magnet 46 to thereby detect the working position of the piston unit 18.

The piston rod 20 is a columnar (circular cylindrical) member extending in the axial direction of the slide hole 13. As shown in FIG. 2, the piston rod 20 penetrates through the rod cover 14. A distal end portion 20*b* of the piston rod 20 is exposed to the outside of the slide hole 13. A first cushion ring 69*a* is secured to an outer circumferential portion of the piston rod 20 at a position adjacent to a portion of the piston body 40 facing the rod cover 14. A second cushion ring 69*b* is secured to the piston rod 20 on the opposite side of the piston body 40 from the first cushion ring 69*a*. The base end portion 20*a* of the piston rod 20 is secured to the piston body 40 by swaging or crimping.

The first cushion packing 68*a*, the second cushion packing 68*b*, the first cushion ring 69*a*, and the second cushion ring 69*b* constitute an air cushion mechanism reducing the impact at stroke ends. Instead of or in addition to such an air cushion mechanism, dampers composed of an elastic material such as rubber may be attached to, for example, the inner wall surface 14*a* of the rod cover 14 and the inner wall surface 16*a* of the head cover 16.

The fluid pressure cylinder 10 configured as above operates as follows. In the description below, air (compressed air) is used as pressurized fluid. However, gas other than air may be used.

In FIG. 2, in the fluid pressure cylinder 10, the piston unit 18 is moved inside the slide hole 13 in the axial direction by the effect of air serving as the pressurized fluid introduced via the first port 15*a* and the second port 15*b*. This causes the piston rod 20 connected to the piston unit 18 to move back and forth.

Specifically, in order to displace (advance) the piston unit 18 toward the rod cover 14, the first port 15*a* is opened to the atmosphere, and pressurized fluid is then supplied from a pressurized fluid supply source (not shown) to the second pressure chamber 13*b* via the second port 15*b*. This causes the piston unit 18 to be pushed by the pressurized fluid toward the rod cover 14. As a result, the piston unit 18 is displaced (advanced) toward the rod cover 14 together with the piston rod 20.

When the piston unit 18 comes into abutment with the rod cover 14, the advancing motion of the piston unit 18 is stopped. When the piston unit 18 approaches the advanced position, the first cushion ring 69*a* comes into contact with the inner circumferential surface of the first cushion packing 68*a*. This creates an airtight seal at the contact area and thus creates an air cushion in the first pressure chamber 13*a*. As a result, the displacement of the piston unit 18 is decelerated in the vicinity of the stroke end on the rod cover 14 side, and the impact occurring when the piston unit 18 reaches the stroke end is reduced.

On the other hand, in order to displace (return) the piston body 40 toward the head cover 16, the second port 15*b* is opened to the atmosphere, and pressurized fluid is then supplied from the pressure supply source (not shown) to the first pressure chamber 13*a* via the first port 15*a*. This causes the piston body 40 to be pushed by the pressurized fluid toward the head cover 16. As a result, the piston unit 18 is displaced toward the head cover 16.

When the piston unit 18 comes into abutment with the head cover 16, the retracing motion of the piston unit 18 is stopped. When the piston unit 18 approaches the retracted position, the second cushion ring 69*b* comes into contact with the inner circumferential surface of the second cushion packing 68*b*. This creates an airtight seal at the contact area and thus creates an air cushion in the second pressure chamber 13*b*. As a result, the displacement of the piston unit 18 is decelerated in the vicinity of the stroke end on the head cover 16 side, and the impact occurring when the piston unit 18 reaches the stroke end is reduced.

In this case, the fluid pressure cylinder 10 according to the first embodiment produces the following effects.

According to the fluid pressure cylinder 10, the wear ring 44 and the magnet 46 are disposed in an identical position in the axial direction, resulting in a reduction in the axial dimension of the piston body 40. As a result, the total length of the fluid pressure cylinder 10 can be reduced.

The magnet 46 is disposed within a range of the axial dimension of the wear ring 44. With this structure, the axial dimension of the wear ring 44 can be reduced.

Furthermore, the wear ring 44 includes the opening portions 59 formed by cutting out portions from the sliding portion 58 in the circumferential direction, and as a result, the magnet 46 can be disposed closer to the inner circumferential surface of the cylinder tube 12 at the opening portions 59. Since the distance between the magnetic sensor 64 attached to the outside of the cylinder tube 12 and the magnet 46 disposed inside the cylinder tube 12 can be reduced, the magnetic force which the magnet 46 is required to have can be reduced. This allows the axial thickness of the magnet 46 to be reduced. Consequently, the axial dimension of the piston body 40 can be reduced, and thus the total length of the fluid pressure cylinder 10 can be reduced.

The protrusions 46*a* of the magnet 46 are disposed in the opening portions 59 of the wear ring 44. This structure allows the magnet 46 to be disposed even closer to the inner circumferential surface of the cylinder tube 12. Thus, the axial thickness of the magnet 46 can be effectively reduced.

Second Embodiment

Figure 5:
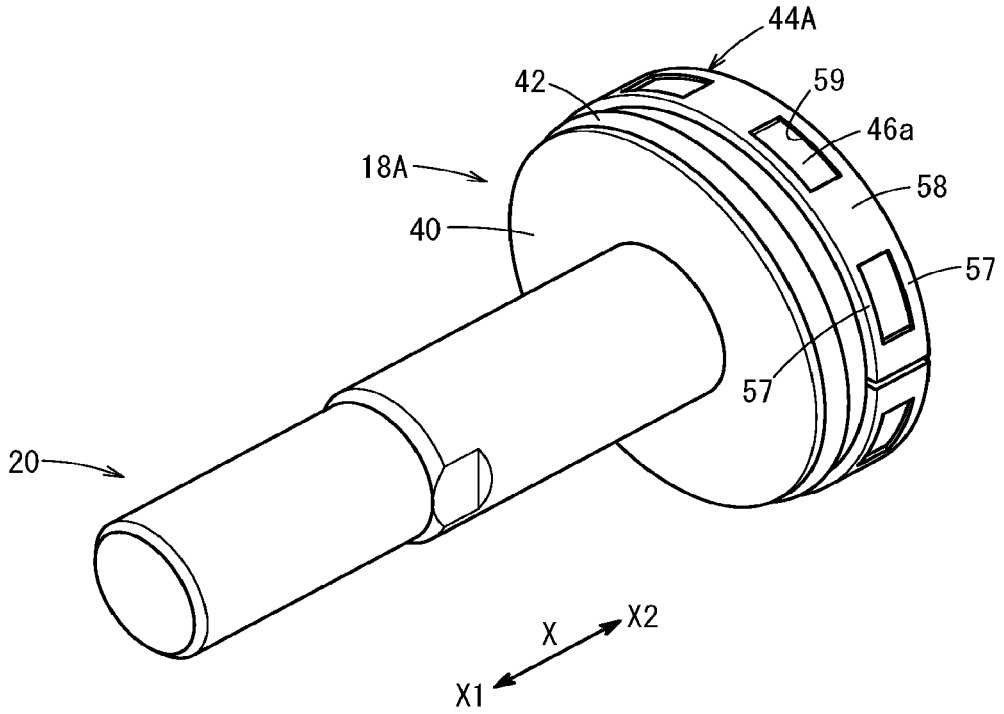
FIG. 5 is a perspective view of a piston unit according to a second embodiment of the present invention.

In the above-described fluid pressure cylinder 10, a piston unit 18A illustrated in FIG. 5 may be used instead of the piston unit 18. The piston unit 18A includes a wear ring 44A having a different shape from the wear ring 44 in FIG. 3. The structure of the piston unit 18A other than this is similar to the structure of the piston unit 18.

As shown in FIG. 5, the wear ring 44A of this embodiment includes the circumferential portions 57 extending in the circumferential direction, the circumferential portions being formed respectively at one end (an end on the X1 direction side) and another end (an end on the X2 direction side) of the wear ring 44A in the axial direction. The sliding portions 58 are supported by the circumferential portions 57 from both ends in the axial direction. The opening portions 59 are formed between the circumferential portions 57 disposed at both ends in the axial direction.

Figure 6:
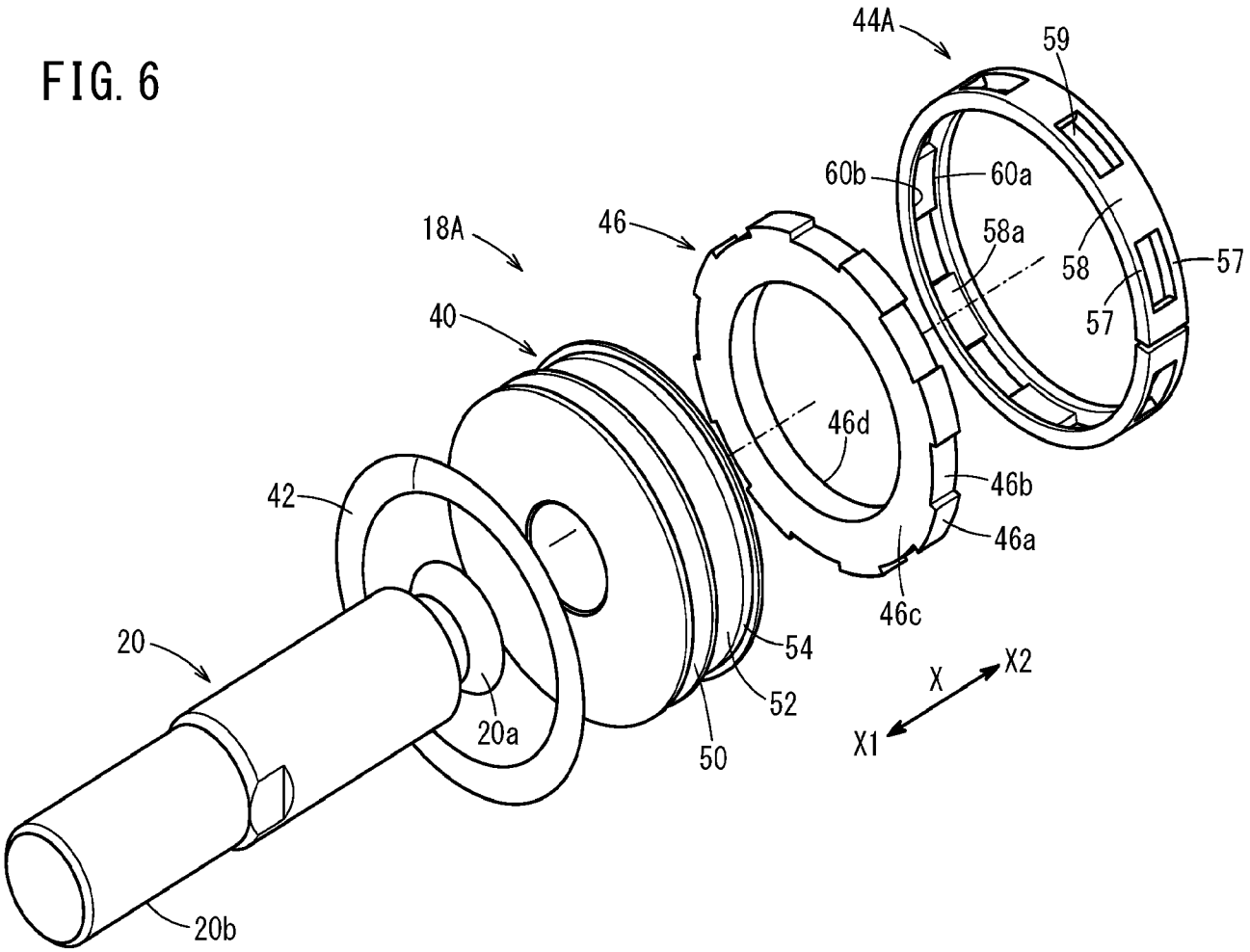
FIG. 6 is an exploded perspective view of the piston unit in FIG. 5.

As shown in FIG. 6, the circumferential portions 57 have respectively the first catch portion 60*a* and the second catch portion 60*b* formed on the respective inner circumferences thereof so as to protrude more inward in the radial direction than the inner circumferential surfaces 58*a* of the sliding portions 58. The wear ring 44A is attached to the magnet 46 such that one end face 46*c* and the other end face 46*d* of the magnet 46 in the axial direction are held between the first catch portion 60*a* and the second catch portion 60*b*. As shown in FIG. 2, the first catch portion 60*a* and the second catch portion 60*b* are accommodated in the wear ring arrangement groove 54 of the piston body 40.

The fluid pressure cylinder 10 using the wear ring 44A according to the second embodiment produces effects similar to those produced in the first embodiment. Moreover, the wear ring 44A includes the circumferential portions 57 formed at the one end and the other end in the axial direction, and the ring shape of the wear ring 44A is maintained by the circumferential portions 57. This provides excellent strength for the wear ring 44A. As a result, the axial dimension of the circumferential portions 57 can be reduced, leading to a further reduction in the axial dimension of the piston body 40. Part of the second embodiment common to that of the first embodiment produces effects identical or similar to those of the first embodiment.

The present invention has been described with reference to preferred embodiments. However, the present invention is not limited in particular to the above-described embodiments, and various modifications can be made thereto without departing from the scope of the present invention as a matter of course.

The invention claimed is:

1. A fluid pressure cylinder, comprising:

a cylinder tube containing therein a slide hole;

a piston unit disposed to be reciprocable along the slide hole; and a piston rod protruding from the piston unit in an axial direction, wherein:

the piston unit includes:

a piston body protruding radially outward from the piston rod;

a packing attached to an outer circumferential part of the piston body;

a ring-shaped magnet attached to the outer circumferential part of the piston body; and a wear ring attached to an outer circumferential part of the ring-shaped magnet, wherein:

a plurality of opening portions are formed at intervals in a circumferential direction at an outer circumferential part of the wear ring, and a plurality of protrusions protruding radially outward are formed at intervals in the circumferential direction at the outer circumferential part of the magnet, the protrusions being inserted into the opening portions of the wear ring.

2. The fluid pressure cylinder according to claim 1, wherein the magnet is disposed within an axial range of the wear ring.

3. The fluid pressure cylinder according to claim 1, wherein a central portion of the magnet and a central portion of the wear ring in the axial direction coincide with each other.

4. The fluid pressure cylinder according to claim 1, wherein a circumferential portion extending in the circumferential direction is formed at an end of the wear ring in the axial direction.

5. The fluid pressure cylinder according to claim 1, wherein a circumferential portion extending in the circumferential direction is formed at each of both ends of the wear ring in the axial direction.

6. The fluid pressure cylinder according to claim 1, wherein an outer circumferential surface of each of the protrusions of the magnet is formed in a position being radially identical to or protruding radially outward from a position of an outer circumferential surface of the piston body.

7. The fluid pressure cylinder according to claim 6, wherein a height of the protrusions of the magnet is within a range of a thickness of the wear ring.

8. The fluid pressure cylinder according to claim 1, wherein a circumferential width of the protrusions of the magnet is greater than a circumferential width of recesses.

9. The fluid pressure cylinder according to claim 1, wherein the wear ring includes a first catch portion configured to be brought into abutment with one end face of the magnet in the axial direction and a second catch portion configured to be brought into abutment with another end face of the magnet in the axial direction.

10. The fluid pressure cylinder according to claim 1, wherein:

the piston body includes a packing receiving groove, a magnet arrangement groove, and a wear ring arrangement groove, each having a circular ring shape, formed in the outer circumferential part of the piston body;

the wear ring arrangement groove is wider in the axial direction and shallower than the magnet arrangement groove; and the magnet arrangement groove is formed within a range of an axial width of the wear ring arrangement groove.

11. The fluid pressure cylinder according to claim 10, wherein a central position of the magnet arrangement groove in the axial direction and a central position of the wear ring arrangement groove in the axial direction coincide with each other.

* * * * *